US007618355B1

(12) United States Patent
Murdock

(10) Patent No.: US 7,618,355 B1
(45) Date of Patent: Nov. 17, 2009

(54) RESISTANCE EXERCISE APPARATUS

(76) Inventor: Frederick L. Murdock, 823 Harian Ave., Saint Louis, MO (US) 63147

( * ) Notice: Subject to any disclaimer, the term of this patent is extended or adjusted under 35 U.S.C. 154(b) by 0 days.

(21) Appl. No.: 11/828,658

(22) Filed: Jul. 26, 2007

(51) Int. Cl.
*A63B 21/068* (2006.01)

(52) U.S. Cl. ..... 482/96; 482/23; 482/110; 482/121; 482/142

(58) Field of Classification Search ..... 482/124, 482/96
See application file for complete search history.

(56) References Cited

U.S. PATENT DOCUMENTS 1,104,505 A * 7/1914 Holwarthy ..... 482/24
3,064,972 A * 11/1962 Feinn ..... 482/81
3,218,065 A * 11/1965 Anderson ..... 482/148
3,967,333 A * 7/1976 Boyd ..... 5/424
4,052,070 A 10/1977 Lew
4,198,044 A * 4/1980 Holappa ..... 482/130
D259,805 S * 7/1981 Persson ..... D21/826
4,296,924 A * 10/1981 Anzaldua et al. ..... 482/139
D262,813 S * 1/1982 Lambert et al. ..... D21/675
D265,111 S * 6/1982 Lynn ..... D21/673
D265,575 S * 7/1982 Lunford ..... D21/691
D269,363 S * 6/1983 Dieter et al. ..... D21/826
4,431,184 A 2/1984 Lew et al.
4,638,995 A * 1/1987 Wilson ..... 482/142
4,687,196 A * 8/1987 Dubrinsky et al. ..... 482/69
4,706,953 A * 11/1987 Graham ..... 482/96
D306,467 S * 3/1990 Smith ..... D21/691
4,911,438 A * 3/1990 Van Straaten ..... 482/96
4,941,658 A * 7/1990 Poo ..... 482/35
4,998,723 A * 3/1991 Santoro ..... 482/104
5,024,214 A * 6/1991 Hayes ..... 606/241
5,042,797 A * 8/1991 Graham ..... 482/96
5,106,079 A * 4/1992 Escobedo et al. ..... 482/97
5,176,602 A * 1/1993 Roberts ..... 482/131
5,261,865 A * 11/1993 Trainor ..... 482/95
5,290,209 A * 3/1994 Wilkinson ..... 482/38
D350,172 S * 8/1994 Rusk ..... D21/693
5,374,225 A * 12/1994 Wilkinson ..... 482/27
5,405,306 A * 4/1995 Goldsmith et al. ..... 482/120
5,407,411 A * 4/1995 Trainor ..... 482/95
D358,623 S * 5/1995 Macasieb ..... D21/691
5,499,949 A * 3/1996 Heubl ..... 472/105
5,658,037 A * 8/1997 Evans et al. ..... 296/98
5,667,461 A * 9/1997 Hall ..... 482/69
5,758,196 A * 5/1998 Laing ..... 396/1
5,785,667 A * 7/1998 Forner ..... 601/23
5,788,606 A * 8/1998 Rich ..... 482/27
5,846,170 A * 12/1998 Ho ..... 482/125
5,857,945 A * 1/1999 Papp et al. ..... 482/124
D408,480 S * 4/1999 Haugo ..... D21/691
5,941,798 A * 8/1999 Coan et al. ..... 482/27
5,967,950 A * 10/1999 Hsu ..... 482/96
6,053,845 A * 4/2000 Publicover et al. ..... 482/35

(Continued)

*Primary Examiner*—Loan H Thanh
*Assistant Examiner*—Robert F Long
(74) *Attorney, Agent, or Firm*—Crossley Patent Law; Mark A. Crossley

(57) ABSTRACT

A lightweight resistance exercise apparatus providing easy disassembly, portability, adjustable rope resistance, and full choice of exercises of an almost endless variety. The apparatus selectively positions a user within a framework and provides for selectively self-securing of the user. Rope resistance is adjustable up to 700 pounds for each rope equipped elbow at each corner of the framework. Ropes return to a retracted position when released.

4 Claims, 4 Drawing Sheets

U.S. PATENT DOCUMENTS 6,106,437 A * 8/2000 Brooks ..... 482/10
6,106,444 A * 8/2000 Maingart ..... 482/95
6,110,048 A * 8/2000 Murray ..... 472/16
6,220,994 B1 * 4/2001 Rich ..... 482/123
6,241,642 B1 * 6/2001 Slenker ..... 482/114
6,280,361 B1 * 8/2001 Harvey et al. ..... 482/8
6,299,569 B1 * 10/2001 Rich ..... 482/123
6,402,669 B1 * 6/2002 Olstad ..... 482/123
6,537,185 B1 * 3/2003 Hur ..... 482/142
6,554,747 B1 * 4/2003 Rempe ..... 482/38
6,652,419 B1 * 11/2003 Rota ..... 482/27
6,666,798 B2 * 12/2003 Borsheim ..... 482/54
6,692,417 B2 * 2/2004 Burrell ..... 482/142
6,932,750 B1 * 8/2005 Dorner ..... 482/142
6,942,487 B2 * 9/2005 Corbalis ..... 434/247
7,179,207 B2 * 2/2007 Gerschefske ..... 482/95
2001/0029628 A1 * 10/2001 Ferrand et al. ..... 5/600
2002/0091047 A1 * 7/2002 Olstad ..... 482/123
2002/0137598 A1 * 9/2002 Publicover et al. ..... 482/27
2003/0004042 A1 * 1/2003 Burrell ..... 482/121
2004/0043873 A1 * 3/2004 Wilkinson et al. ..... 482/54
2005/0005871 A2 * 1/2005 Farmer et al. ..... 119/474
2005/0020418 A1 * 1/2005 Lin ..... 482/142
2005/0026755 A1 * 2/2005 Greene ..... 482/110
2006/0201442 A1 * 9/2006 Farmer et al. ..... 119/474

* cited by examiner

RESISTANCE EXERCISE APPARATUS

BACKGROUND OF THE INVENTION

Exercise devices are provided in a variety of sizes, styles, and means of providing exercise for an individual. The most useful exercise devices provide some means of resistance against which exercises are performed. Resistance is provided in a variety of ways, with a personal exercise device preferably providing lightweight resistance, as opposed to heavy weights or other mechanisms of heavy resistance. Lightweight resistance provides for a more portable, less cumbersome device. Further, a desirable lightweight resistance exercise device incorporates some means for at least partial disassembly of the device, for even greater portability. The present apparatus provides lightweight, portable, resistance exercise. The present apparatus can be disassembled and height adjusted. The present apparatus provides adjustable resistance and a means for stabilizing an individual using the apparatus.

FIELD OF THE INVENTION

The resistance exercise apparatus relates to individual exercise devices and more especially to a lightweight resistance exercise apparatus which is portable, capable of disassembly, height adjustable, and resistance adjustable.

SUMMARY OF THE INVENTION

The general purpose of the present resistance exercise apparatus, described subsequently in greater detail, is to provide a resistance exercise apparatus which has many novel features that result in an improved resistance exercise apparatus which is not anticipated, rendered obvious, suggested, or even implied by prior art, either alone or in combination thereof.

To attain this, the resistance exercise apparatus is assembled to provide an external framework within which a user is positioned. The apparatus is made of various materials, which can include aluminum, alloys, plastics, and other lightweight choices in material makeup. Ropes are provided for resistance, which is adjustable. Each rope is individually adjustable. Each rope returns to a retracted starting position via recoil tension springs incorporated into each resistance rope mechanism disposed at each elbow. Stops are employed on the ropes to prevent full rope retreat within the elbows to which each rope is respectively secured. Resistance of up to 700 pounds is provided, adjustably. The secured waist surround provides for securing a user as chosen. The uprights slideably fitted within the verticals provide for height adjustment relative to a user. The ankle and hand straps can be employed in any imaginable way. The rubberized mat provides for better user traction and cushion comfort.

Thus has been broadly outlined the more important features of the improved resistance exercise apparatus so that the detailed description thereof that follows may be better understood and in order that the present contribution to the art may be better appreciated.

An object of the resistance exercise apparatus is to provide resistance exercise for an individual.

Another object of the resistance exercise apparatus is to provide for disassembly.

A further object of the resistance exercise apparatus is to provide portability.

An added object of the resistance exercise apparatus is to provide a lightweight apparatus.

And, an object of the resistance exercise apparatus is to provide adjustable resistance.

These together with additional objects, features and advantages of the improved resistance exercise apparatus will be readily apparent to those of ordinary skill in the art upon reading the following detailed description of presently preferred, but nonetheless illustrative, embodiments of the improved resistance exercise apparatus when taken in conjunction with the accompanying drawings.

In this respect, before explaining the current embodiments of the improved resistance exercise apparatus in detail, it is to be understood that the resistance exercise apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved resistance exercise apparatus. It is therefore important that the claims be regarded as including such equivalent constructions insofar as they do not depart from the spirit and scope of the resistance exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the resistance exercise apparatus generally designated by the reference number 10 will be described.

Figure 1:
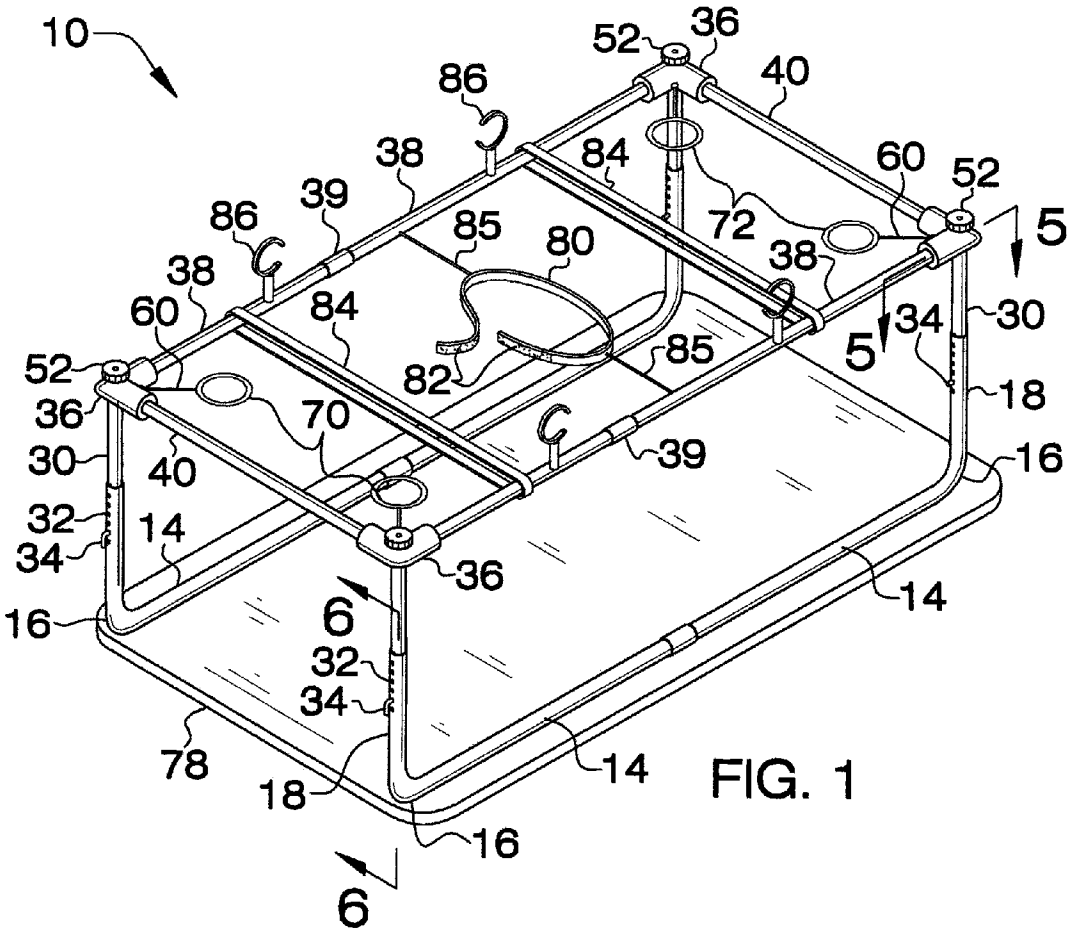
FIG. 1 is a perspective view.
Figure 2:
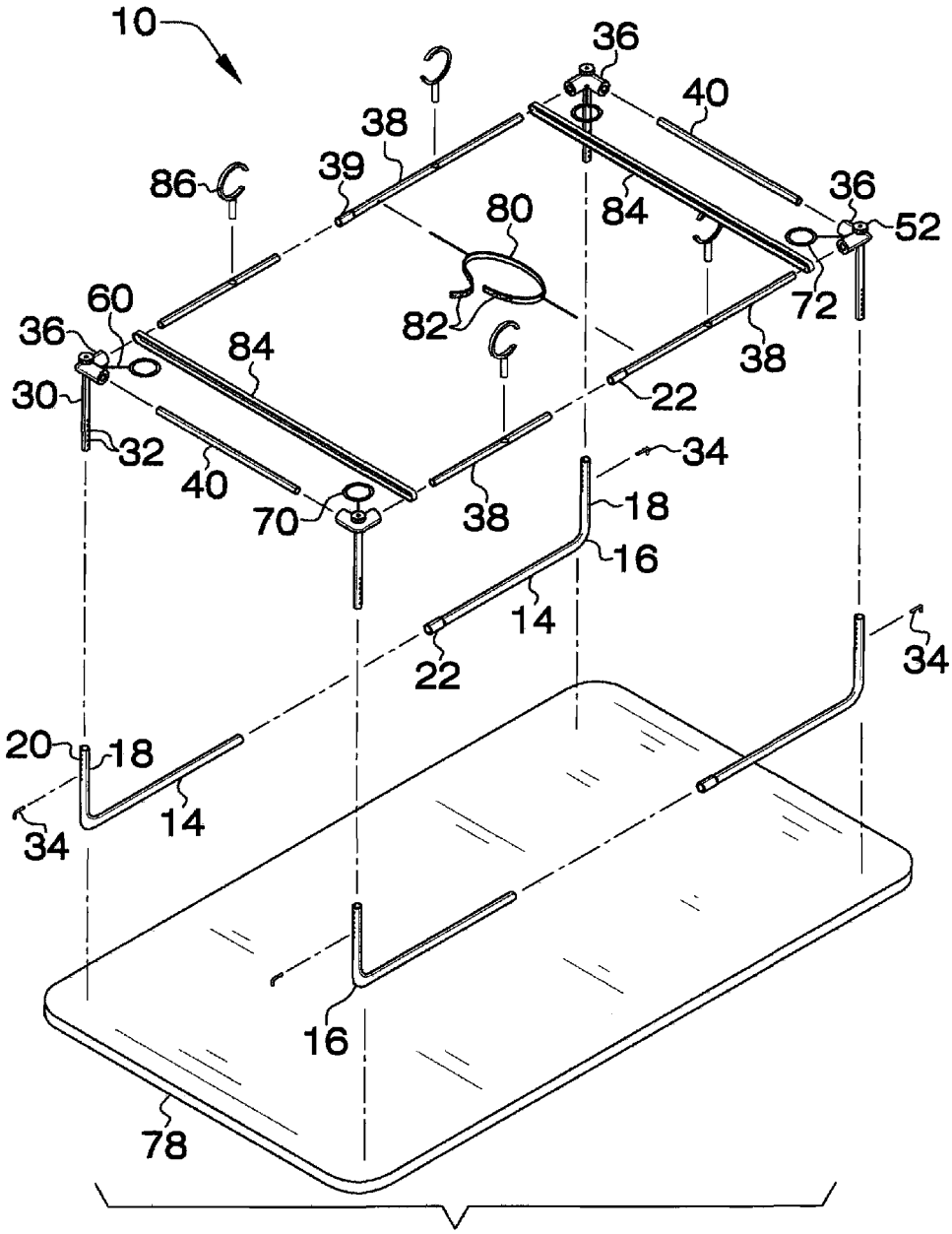
FIG. 2 is an exploded perspective view.

Referring to FIGS. 1 and 2, the apparatus 10 comprises a tubular framework within which a user 100 is positioned having a first end 11 spaced apart from a second end 12. The horizontal first leg 14*a* is joined to the horizontal third leg 14*c* via the first leg collar 22*a*. The first leg 14*a* has a first bend 16*a* extended into the first vertical member 18*a*. The third leg 14*c* has a third bend 16*c* extended into the third vertical member 18*c*. The horizontal second leg 14*b* is joined to the horizontal fourth leg 14*d* via the second leg collar 22*b*. The second leg 14*b* has a second bend 16*b* extended into the second vertical member 18*b*. The fourth leg 14*d* has a fourth bend 16*d* extended into the fourth vertical member 18*d*. A plurality of identical vertical member orifices 20 is disposed in each vertical member. An identical upright is slideably disposed within each vertical member. The uprights comprise the first upright 30*a* disposed within the first vertical member 18*a*, the second upright 30*b* disposed within the second vertical member 18*b*, the third upright 30*c* disposed within the third vertical member 18*c*, and the fourth upright 30*d* disposed within the fourth vertical member 18*d*.

Figure 6:
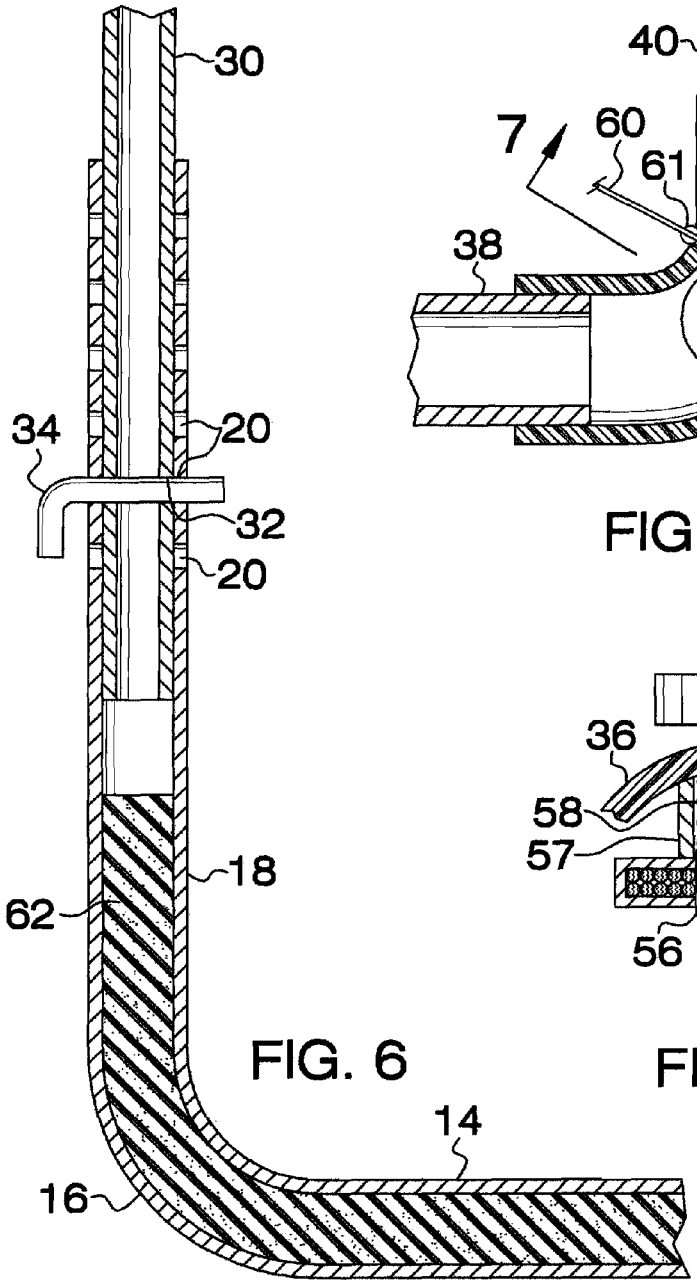
FIG. 6 is a partial cross sectional view of FIG. 1.

Referring to FIG. 6 and continuing to refer to FIGS. 1 and 2, each upright has a plurality of identical upright orifices 32. A quartet of identical pins 34 is provided. One pin 34 is inserted into the first upright 30*a* and first vertical member 18*a*. One pin 34 is inserted into the second upright 30*b* and second vertical member 18*b*. One pin 34 is inserted into the third 30*d* and fourth vertical member 18*d*. The pins 34 enable a user 100 to position the overall height of the apparatus 10 as desired.

Figure 5:
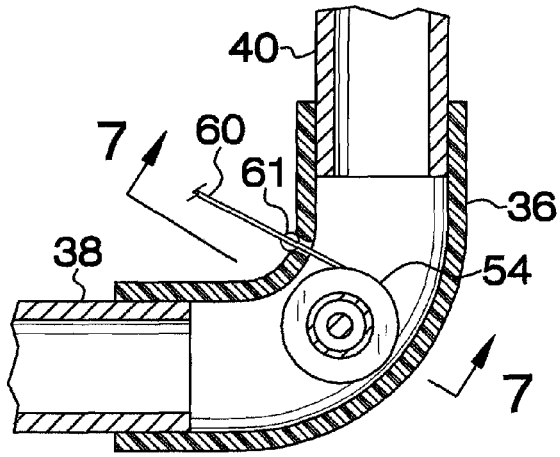
FIG. 5 is a partial cross sectional view of FIG. 1.
Figure 7:
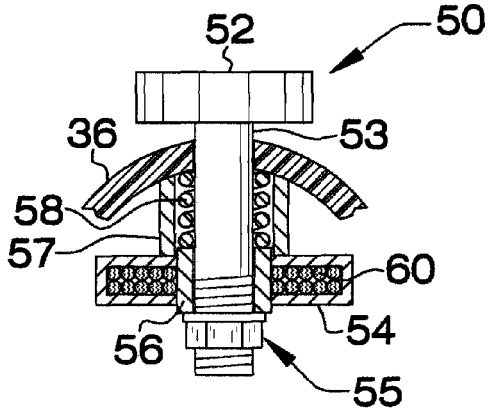
FIG. 7 is a partial cross sectional view of FIG. 5.

Referring to FIGS. 5 and 7 and continuing to refer to FIGS. 1 and 2, four identical resistance rope mechanisms 50 are provided. One resistance rope mechanism 50 is fitted atop the first upright 30*a*. One resistance rope mechanism 50 is fitted atop the second upright 30*b*. One resistance rope mechanism 50 is fitted atop the third upright 30*c*. One resistance rope mechanism 50 is fitted atop the fourth upright 30*d*. The resistance rope mechanisms 50 comprise identical 90 degree elbows comprising a first elbow 36*a*, a second elbow 36*b*, a third elbow 36*c*, and a fourth elbow 36*d*. Each resistance rope mechanism 50 further comprises a shaft 53 rotatable fitted within the elbow. A knob 52 is affixed atop the shaft 53. The knob 52 is the shaft 53. A spring bushing 56 is rotatable disposed around the shaft 53. The bushing 56 is adjacent to the washer 55*b*. A circular spool 54 surrounds the bushing 56. A rope 60 is disposed on the spool 54. The rope 60 is extended outwardly from the elbow. The rope 60 has a stop 61 on the exterior of the elbow such that the rope 60 cannot retreat totally into the elbow. A tension spring 58 is disposed around the shaft 53. A spacer 57 is disposed between the spool 54 and the interior of the elbow and surrounds the tension spring 58.

Figure 3:
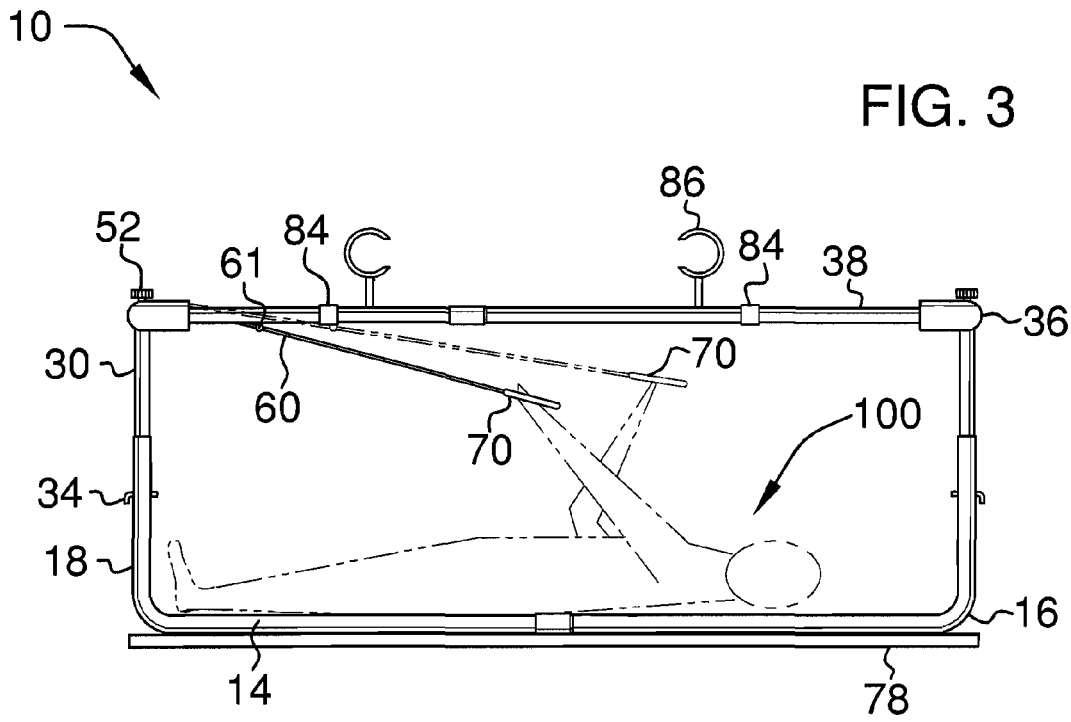
FIG. 3 is side elevation view with user.
Figure 4:
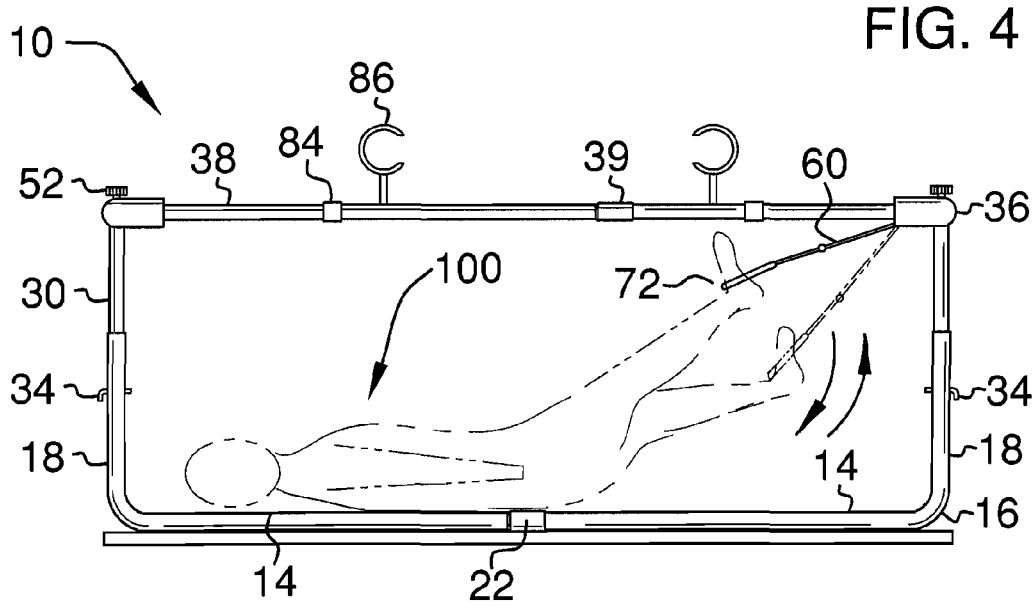
FIG. 4 is a side elevation view with user.

Referring to FIGS. 3 and 4, and continuing to refer to FIGS. 1 and 2, tightening of the knob 52 increases rotational resistance of the spool 54, thereby increasing the difficulty of pulling the rope 60 outwardly, providing greater resistance to a user 100. Conversely, loosing the knob 52 decreases rotational resistance of the spool 54, thereby decreasing rope 60 pull resistance to a user 100. The first hand strap 70*a* is affixed to the rope 60 of the first elbow 36*a*. The second hand strap 70*b* is affixed to the rope 60 of the second elbow 36*b*. The first ankle strap 72*a* is affixed to the rope 60 of the third elbow 36*c*. The second ankle strap 72*b* is affixed to the rope 60 of the fourth elbow 36*d*. The first short longitudinal member 38*a* is inserted into the first elbow 36*a*. The first long longitudinal member 38*c* is inserted into the third elbow 36*c*. The first longitudinal collar 39*a* joins the first short longitudinal member 38*a* to the first long longitudinal member 38*c*. The second short longitudinal member 38*b* is inserted into the second elbow 36*b*. The second long longitudinal member 38*d* is inserted into the fourth elbow 36*d*. The second longitudinal collar 39*b* joins the second short longitudinal member 38*b* to the second long longitudinal member 38*d*. The first transverse member 40*a* is inserted into the first elbow 36*a* and the second elbow 36*b* at the first end 11. The second transverse member 40*b* is inserted into the third elbow 36*c* and the fourth elbow 36*d* at the second end 12. The rubberized mat 78 is disposed below the framework and provides both comfort and traction to the user 100.

Continuing to refer to FIGS. 1 and 3, the first elastic band 84*a* is disposed around the first short longitudinal member 38*a* and the second short longitudinal member 38*b*. The second elastic band 84*b* is disposed around the first long longitudinal member 38*c* and the second long longitudinal member 38*d*. The elastic bands provide still further resistance to various movements of a user 100. The elastic bands are looped through the partial loops as desired. The first partial loop 86*a* is inserted into the first short longitudinal member 38*a*. The second partial loop 86*b* is inserted into the second short longitudinal member 38*b*. The third partial loop 86*c* is inserted into the first long longitudinal member 38*c*. The fourth partial loop 86*d* is inserted into the second long longitudinal member 38*d*. The first surround securement 85*a* is affixed to the first long longitudinal member 38*c*. The second surround securement 85*b* is affixed to the second long longitudinal member 38*d*. The waist surround 80 with hook and loop 82 is affixed to the surround securements. The waist surround 80 can thereby anchor a user's 100 position within the framework when in a standing position.

Referring again to FIG. 6, each bend of the apparatus 10 further comprises a fill material 62 providing greater rigidity to the apparatus 10.

Referring again to FIGS. 3 and 4, the user 100 performs resistance exercise within the framework in a supine position. The mat 78 provides cushioning. In FIG. 3, the user 100 has grasped the first hand strap 70*a* and is performing a biceps curl. The user's 100 left hand grasps the second hand strap 70*b* and alternates biceps curl movement with the right hand. Referring again to FIG. 4, the user 100 left foot is hooked into the first ankle strap 72*a*, with the right foot hooked into the second ankle strap 72*b*. The user 100 is alternating scissor kick movements with each leg.

With respect to the above description then, it is to be realized that the optimum dimensional relationships for the parts of the resistance exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the resistance exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the resistance exercise apparatus may be used.

Therefore, the foregoing is considered as illustrative only of the principles of the resistance exercise apparatus. Further, since numerous modifications and changes will readily occur to those skilled in the art, it is not desired to limit the resistance exercise apparatus to the exact construction and operation shown and described, and accordingly, all suitable modifications and equivalents may be resorted to, falling within the scope of the resistance exercise apparatus.

What is claimed is:

1. A resistance exercise apparatus comprising a framework within which a user is positioned, the frame work comprising:

a first end spaced apart from a second end;

a horizontal first leg joined to a horizontal third leg via a first leg collar, the first leg having a first bend extended into a first vertical member, the third leg having a third bend extended into a third vertical member, a horizontal second leg joined to a horizontal fourth leg via a second leg collar, the second leg having a second bend extended into a second vertical member, the fourth leg having a fourth bend extended into a fourth vertical member;

a plurality of identical uprights vertical member orifices disposed in each vertical member;

an identical upright slideably disposed within each vertical member, the uprights comprising a first upright disposed within the first vertical member, a second upright disposed within the second vertical member, a third upright disposed within the third vertical member, a fourth upright disposed within the fourth vertical member, each upright having a plurality of identical upright orifices;

a quartet of identical pins, one pin inserted into the first upright and first vertical member, one pin inserted into the second upright and second vertical member, one pin inserted into the third upright and third vertical member, one pin inserted into the fourth upright and fourth vertical member;

four identical resistance rope mechanisms, one resistance rope mechanism fitted atop the first upright, one resistance rope mechanism fitted atop the second upright, one resistance rope mechanism fitted atop the third upright, one resistance rope mechanism fitted atop the fourth upright, the resistance rope mechanisms comprising identical 90 decree elbows comprising a first elbow, a second elbow, a third elbow, and a fourth elbow, each resistance rope mechanism further comprising:

a shaft rotatably fitted within the elbow;

a knob affixed atop the shaft, the knob extended above each elbow;

a nut with washer disposed on a bottom of the shaft;

a spring bushing rotatably disposed around the shaft, the bushing adjacent to the washer;

a circular spool surrounding the bushing;

a rope disposed on the spool, the rope extended outwardly from the elbow, the rope having a stop on an exterior of the elbow;

a tension spring disposed around the shaft;

a spacer disposed between an elbow interior and the spool, the spacer surrounding the tension spring;

wherein a tightening of the knob increasing a rotational resistance of the spool;

a first hand strap affixed to the rope of the first elbow;

a second hand strap affixed to the rope of the second elbow;

a first ankle strap affixed to the rope of the third elbow;

a second ankle strap affixed to the rope of the fourth elbow;

a first short longitudinal member inserted into the first elbow;

a first long longitudinal member inserted into the third elbow;

a first longitudinal collar joining the first short longitudinal member to the first long longitudinal member;

a second short longitudinal member inserted into the second elbow;

a second long longitudinal member inserted into the fourth elbow;

a second longitudinal collar joining the second short longitudinal member to the second long longitudinal member;

a first transverse member inserted into the first elbow and the second elbow at the first end;

a second transverse member inserted into the third elbow and the fourth elbow at the second end;

a first partial loop inserted into the first short longitudinal member;

a second partial loop inserted into the second short longitudinal member;

a third partial loop inserted into the first long longitudinal member;

a fourth partial loop inserted into the second long longitudinal member.

2. A resistance exercise apparatus comprising a framework within which a user is positioned, the frame work comprising:

a first end spaced apart from a second end;

a horizontal first leg joined to a horizontal third leg via a first leg collar, the first leg having a first bend extended into a first vertical member, the third leg having a third bend extended into a third vertical member, a horizontal second leg joined to a horizontal fourth leg via a second leg collar, the second leg having a second bend extended into a second vertical member, the fourth leg having a fourth bend extended into a fourth vertical member;

a plurality of identical vertical member orifices disposed in each vertical member;

a plurality of identical uprights slideably disposed within each vertical member, the uprights comprising a first upright disposed within the first vertical member, a second upright disposed within the second vertical member, a third upright disposed within the third vertical member, a fourth upright disposed within the fourth vertical member, each upright having a plurality of identical upright orifices;

a quartet of identical pins, one pin inserted into the first upright and first vertical member, one pin inserted into the second upright and second vertical member, one pin inserted into the third upright and third vertical member, one pin inserted into the fourth upright and fourth vertical member;

four identical resistance rope mechanisms, one resistance rope mechanism fitted atop the first upright, one resistance rope mechanism fitted atop the second upright, one resistance rope mechanism fitted atop the third upright, one resistance rope mechanism fitted atop the fourth upright, the resistance rope mechanisms comprising identical 90 degree elbows comprising a first elbow, a second elbow, a third elbow, and a fourth elbow, each resistance rope mechanism further comprising:

a shaft rotatably fitted within the elbow;

a knob affixed atop the shaft, the knob extended above the elbow;

a nut with washer disposed on a bottom of the shaft;

a spring bushing rotatably disposed around the shaft, the bushing adjacent to the washer;

a circular spool surrounding the bushing;

a rope disposed on the spool, the rope extended outwardly from the elbow, the rope having a stop on an exterior of the elbow;

a tension spring disposed around the shaft;

a spacer disposed between an elbow interior and the spool, the spacer surrounding the tension spring;

a tightening of the knob increasing a rotational resistance of the spool;

a first hand strap affixed to the rope of the first elbow;

a second hand strap affixed to the rope of the second elbow;

a first ankle strap affixed to the rope of the third elbow;

a second ankle strap affixed to the rope of the fourth elbow;

a first short longitudinal member inserted into the first elbow;

a first long longitudinal member inserted into the third elbow;

a first longitudinal collar joining the first short longitudinal member to the first long longitudinal member;

a second short longitudinal member inserted into the second elbow;

a second long longitudinal member inserted into the fourth elbow;

a second longitudinal collar joining the second short longitudinal member to the second long longitudinal member;

a first transverse member inserted into the first elbow and the second elbow at the first end;

a second transverse member inserted into the third elbow and the fourth elbow at the second end;

a rubberized mat disposed below the framework;

a first elastic band disposed around the first short longitudinal member and the second short longitudinal member;

a second elastic band disposed around the first long longitudinal member and the second long longitudinal member;

a first partial loop inserted into the first short longitudinal member;

a second partial loop inserted into the second short longitudinal member;

a third partial loop inserted into the first long longitudinal member;

a fourth partial loop inserted into the second long longitudinal member.

3. The apparatus according to claim 2 further comprising a first securement affixed to the first long longitudinal member;

a second securement affixed to the second long longitudinal member;

a waist surround with hook and loop affixed to the surround securements.

4. The apparatus according to claim 3 wherein each of the first bend, second bend, third bend, and fourth bend further comprises a fill material.

* * * * *